United States Patent [19]

Palmer et al.

[11] 3,956,553

[45] May 11, 1976

[54] FLOCKED FABRICS AND A PROCESS FOR MAKING THEM

[75] Inventors: Bryan Albert Palmer; Michael Frank Culpin, both of Pontypool, England

[73] Assignee: Imperial Chemical Industries Limited, London, England

[22] Filed: Feb. 5, 1973

[21] Appl. No.: 329,332

[30] Foreign Application Priority Data

Feb. 7, 1972 United Kingdom ..... 5491/72

[52] U.S. Cl. ..... 428/90; 427/206; 427/402; 427/435; 428/95; 428/96

[51] Int. Cl.[2] ..... B05D 1/14; B05D 1/16; B32B 33/00

[58] Field of Search ..... 161/64, 62, 63, 65, 161/66, 67; 117/17, 19, 26, 28, 93.4 R, 93.4 NC, 93.41, 139.5 R; 428/95, 96, 90; 427/180, 206, 402, 435

[56] References Cited

UNITED STATES PATENTS

| | | | |
|---|---|---|---|
| 2,592,602 | 4/1952 | Saks | 117/26 X |
| 3,459,579 | 8/1969 | Newman | 117/33 |
| 3,511,704 | 5/1970 | Wyss | 117/26 X |
| 3,708,321 | 1/1973 | Spieles | 117/26 |
| 3,772,131 | 11/1973 | Triplett | 161/64 |
| 3,772,132 | 11/1973 | Dulin | 161/64 |

*Primary Examiner*—Marion E. McCamish
*Attorney, Agent, or Firm*—Cushman, Darby & Cushman

[57] ABSTRACT

A process for making an improved flocked fabric and the fabric thereby produced.

The process comprises sequentially the steps of:

a. forming a bonded base-web comprising thermoplastic fibres or filaments,
b. applying a uniform amount of adhesive to the bonded base-web,
c. applying flock fibres to the adhesively coated base web and drying the adhesive,
d. applying a uniform amount of adhesive in a dilute solution and drying the adhesive.

The product is characterised by encapsulation of the flock fibres in adhesive.

12 Claims, 1 Drawing Figure

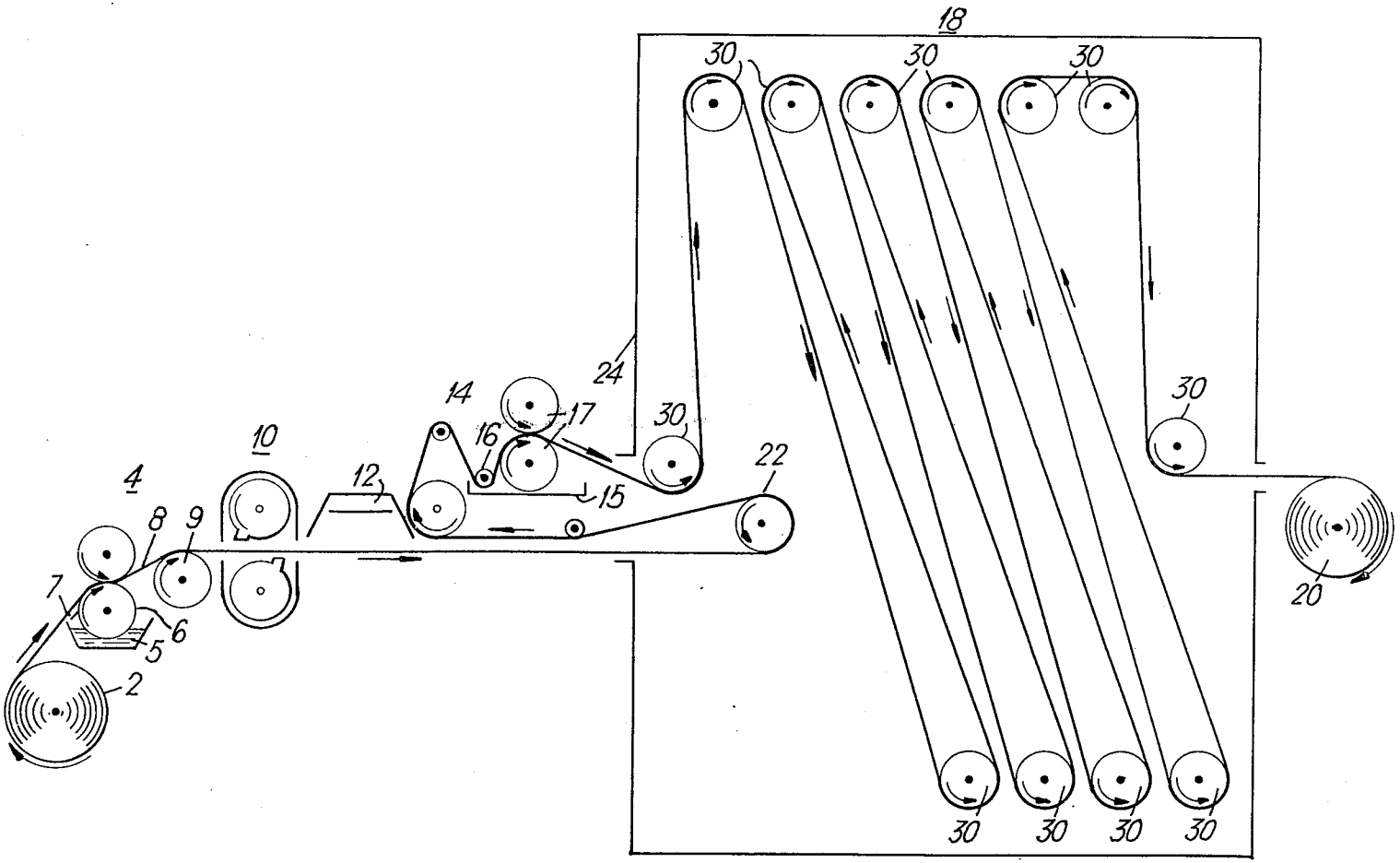
2
4
5
6
7
8
9
10
12
14
15
16
17
18
20
22
24
30

FLOCKED FABRICS AND A PROCESS FOR MAKING THEM

The invention relates to a process for making non-woven fabrics and to non-woven fabrics so produced. More particularly it relates to a process for making an improved non-woven fabric of the type comprising a non-woven base web which supports, and is rendered more opaque by flock fibres adhered thereto, and to such flocked fabrics.

Non-woven fabrics comprising a base-web to which flock fibres are adhered by an adhesive, hereinafter referred to as flocked fabrics, are known and have found many applications, for example, in markets in which a relatively cheap, short-life fabric is desired, for instance as surgical drapes and gowns. Such fabrics, however, tend to lint (that is, flock fibres become detached from the base-web), and to overcome this problem, so much adhesive would need to be applied that the drape and handle of the fabric would be adversely affected and a stiff, rough product would be produced.

We have now found that an improved, substantially non-linting flocked fabric is readily obtained if, after flock fibres have been applied to a base web coated with adhesive, and the flocked fabric treated to dry the adhesive, a second application of adhesive in a solution dilute compared to the first adhesive application is made to the fabric.

Accordingly, the invention, in one of its aspects, provides a process for making a substantially non-linting flocked fabric comprising sequentially the steps of:

a. forming a base-web comprising thermoplastic fibres or filaments,
b. treating the said base-web to bond together said fibres or filaments,
c. applying a uniform amount of adhesive to the bonded base-web,
d. applying flock fibres to the adhesively coated base-web,
e. drying the adhesive,
f. applying a uniform amount of adhesive in a dilute solution, and
g. drying the adhesive.

We have found that flock fibres in fabrics produced by the process of the invention are more or less completely coated with dried or cured adhesive. Thus, in another of its aspects, the invention provides a non-woven fabric comprising a base-web of bonded fibres or filaments and flock fibres adhered to said fibres or filaments, wherein the said flock fibres are substantially completely coated with dried adhesive.

The nature and tensile properties of fabrics of the invention will, to a large extent, reflect the nature and tensile properties of the base-web. Thus, a base-web of continuous filaments might be used to produce a drapeable thin fabric and a web of staple fibres might be used to form a relatively bulky article.

The fibres or filaments of the base-web are bonded together by any convenient treatment, such as a heat treatment or treatment with a suitable solvent, plasticiser or swelling agent. Multi-component fibres or filaments having a potentially adhesive component which can be made adhesive under conditions which leave the other component or components unaffected are of particular value because of the relative flexibility of the treatment necessary to cause them to bond. If desired the bonding treatment may take place under pressure.

The flock fibres may be composed of any suitable natural or synthetic fibrous material, for example $\alpha$-cellulose or a polyamide. They may be applied to the adhesively coated base-web by any suitable technique, such as for example in an applied electrostatic field or by the process and apparatus described in our copending U.S. application Ser. No. 283,289. However, the means by which flock fibres are deposited upon a substrate fabric to which adhesive has been applied is not critical.

Preferably, a solution of adhesive is applied in step (b), in which case the concentration of the adhesive solution used in the first application will be of the same order as has been used in the manufacture of prior art flocked fabrics, say 1 part adhesive to 1–4 parts solvent. The concentration of the adhesive solution applied in the second stage should not be more than one quarter, and will generally lie between one quarter and one tenth, of the concentration of the first applied adhesive solution, that is within the range 1 part adhesive to 4–40 parts solvent, preferably 8–40 parts solvent. The term "solution" includes emulsions and suspensions of adhesive in a liquid. Where the nature of the adhesive permits, it may be required to cure and this may be done either in stage (g) or in both stages (e) and (g). The second adhesive application surprisingly does not significantly affect the drape and handle properties of the fabric but does practically eliminate linting.

By way of example only we find, using polyacrylic adhesive to bond cellulose flock fibres to a web of polyamide continuous filaments, that suitable adhesive solutions have the following concentrations:

First stage adhesive: 2 parts solvent/1 part adhesive,
Second stage adhesive: 8–30 parts solvent/1 part adhesive.

The use of a dilute, second stage, adhesive application also permits the manufacturer to introduce with ease desired modifying agents to the product. For example, we find that certain flame retardants and/or water-repellent agents and/or antistatic agents and/or pigments, which are not compatible with concentrated adhesives, can readily and easily be incorporated in the second (dilute) adhesive solution.

Pigments may be applied via the second (dilute) adhesive application stage, to give flocked fabrics having good colour rub fastness and uniform colouration.

The process of the invention makes possible the production of cheap, opaque, low weight fabrics which find end uses as disposable or short-life textile articles.

In a preferred embodiment of the invention a nonwoven fabric having a drape coefficient (as hereinafter defined) of less than 50%, preferably less than 35% comprises a base-web of bicomponent continuous filaments having a core of nylon 66 and a sheath, completely surrounding the core component, of nylon 6, and weighing between 10 and 15 $g.m^{-2}$, the filaments being bonded to each other at cross-over points, and $\alpha$-cellulose flock fibres adhered to the filaments of the base-web at a density of between 10 and 20 $g.m^{-2}$, said flock fibres being oriented in all directions and some, preferably a majority penetrating into or through the base-web, and said flock fibres being substantially completely coated with dried or cured adhesive.

The drape coefficient is determined using the procedure described by Cusick in J. Text. Inst. 1968, 59, T253. Briefly the test involves placing a circular sample of the fabric to be tested on a vertical stand, allowing the fabric to drape under its own weight and measuring the area projected by the draped fabric. The drape coefficient D is defined as $$D = \frac{\text{Projected area of draped fabric}}{\text{Area of fabric sample}} \times 100$$

Low values of D are obtained with fabrics with good drape, whereas stiff fabrics have high values of D.

Flame retardant, antistatic, water-repellent agents and pigments may be incorporated in the material of this embodiment to provide a non-woven textile fabric suitable for use in short-life garments, surgical drapes and the like.

The invention is further described with reference to the drawing, which shows schematically apparatus for producing a flocked fabric by the process of the invention.

In the drawing reference numeral 2 indicates a roll of non-woven fabric which is used as a support for flock fibres. The nature of the non-woven fabric is not critical to the invention and may comprise staple fibres and/or continuous filaments, but the fibres and/or filaments should be bonded together. The fabric is unwound from roll 2 and passes to first adhesive applicator stage 4, comprising adhesive reservoir 5, applicator roll 6 and doctor blade 7. Advantageously applicator roll 6 may be a gravure roll. The fabric bearing adhesive 8, is then advanced via curved roll 9 which acts to maintain the web to width to flock application station 10, which may conveniently be the apparatus described in our copending U.S. application Ser. No. 283,289. Flock fibres may be applied to either or both surfaces of the substrate fabric. The nature of the flock fibres is not critical to our invention and may, for example, be wood pulp ($\alpha$-cellulose) or synthetic in nature, for example, polyamide or polyester. On emerging from flock application station 10, the adhesive is dried and partially cured by heater 12 and by passage into round roll 22 situated within oven 24. The fabric is then passed to second adhesive application stage 14 comprising adhesive reservoir 15, dip roll 16 and nip rolls 17, and thence to a second adhesive curing station 18 comprising oven 24 and rolls 30 and wound up on roll 20.

The invention is further described by the following example which in no way limits the scope of our invention.

EXAMPLE 1

In this example, undrawn bicomponent filaments, which had a core-sheath configuration were used. The core was nylon 66 and the sheath was nylon 6 and the ratio by weight of core to sheath was 50:50.

These filaments were sprayed onto an advancing conveyor surface by aspirator jets traversing above the collector surface to produce a uniform web weighing 12 $g.m^{-2}$. The web was bonded by passing between calendar rolls heated to a temperature of about 190°C at which temperature the sheath component of the filaments became adhesive and bonds formed between contiguous filaments.

The bonded web was passed at a speed of 0.07 $m.s^{-1}$ to a two roll lick-roll/nip adhesive applicator where a dispersal of an acrylic resin (Primal HA8 manufactured by Rohm and Haas Limited) in water (15% solids) was applied to the web. The dispersal also contained ammonium chloride (5 $g.l^{-1}$) to catalyse the curing of the resin on the web, 1 $ml.l^{-1}$ ethylene glycol to reduce the formation of a resin skin on the applicator roll and an anti-foaming agent.

The applicator was adjusted to apply 4.6 $gm^{-2}$ of adhesive to the web.

Flock fibres of $\alpha$-cellulose, of mean length 0.3 mm were uniformly applied to both sides of the web by the apparatus described in our copending U.S. patent application Ser. No. 283,289. A total weight of 14.5 $gm^{-2}$ of flock fibres was applied to the fabric. The flocked web was then passed through a dip tank containing the second adhesive to soak it thoroughly. The dip tank contained the following additives in an aqueous solution/suspension, per liter.

| | | |
|---|---|---|
| Ammonium sulphamate | 80g) | anti-flammable agents |
| di ammonium hydrogen orthophosphate | 15g) | |
| adhesive* | 63 ml | |
| pigment** | 5g | |
| ethylene glycol | 1 ml | —anti-skinning agent |

*The adhesive was Polidene 37-0010 a polyvinylidene chloride resin supplied by Scott-Bader as 55% solids emulsified in water.

**The pigment was Monoprin Green GN, marketed by Imperial Chemical Industries Limited, which is classified as "CI Pigment Green 7".

A trace of antifoam agent was also present.

This solution/emulsion gave about 2.6 $g.m^{-2}$ adhesive, 8.0 $g.m^{-2}$ flame retardants and 0.5 $g.m^{-2}$ pigment on the flocked web.

Finally the product was dried by passage through a commercially available festoon oven at 140°C with a residence time of about 3 mins.

The product was an attractive, soft, lightweight, (about 41 $g.m^{-2}$), drapeable material, having good opaqueness, colour rub fastness and drape. It had the following physical properties.

| | Dry | Wet |
|---|---|---|
| Tensile strength (Kg) | 1.2 | 1.05 |
| Wing tear strength (Kg) | 0.24 | 0.37 |
| Elmendorf tear strength | 0.7 | 1.4 |

The product had a high conductivity compared with a dyed cotton fabric and so was less prone to build-up an electrical charge.

Samples of the fabric were tested for flammability on the apparatus described in ASTM D1230. The fabric was found to have Normal Flammability — class 1 according to US Department of Commerce, Commercial Standard 191-53.

The fabric was considered eminently suited for hospital drapes, surgical gowns and similar end-uses.

Samples were tested for linting, by placing on a clean, flat velvet pad and placing a weight of about 12 $g.cm^{-2}$ on the sample. The fabric was dragged across the velvet at about 2 $cm.sec^{-1}$.

A first sample was taken from the product before the second adhesive was applied, and was tested for linting. The velvet surface showed a fairly heavy deposit of flock, but the finished product was found to leave but a slight trace of flock on the velvet.

EXAMPLE 2

The base-web of Example 1 was coated with adhesive and flock fibres were applied thereto by the procedure described in Example 1. The proportions of adhesive and flock fibres were:

Adhesive (Primal HA8) applied as an aqueous emulsion, 1 part solids to 4 parts water and giving 3.3 $g.m^{-2}$ solids on the flocked fabric, Flock ($\alpha$-cellulose, mean length 0.3 mm) 16.7 $g.m^{-2}$.

A portion of the flocked fabric was then treated in a second adhesive application, the level of adhesive (which was Primal HA8 applied as 1 part solid in 12 parts water) being 9.4 $g.m^{-2}$.

The Cusick drape coefficient D of a sample of the fabric so produced was measured and was compared with the drape coefficient D of a sample which had not been subjected to the second adhesive application step. The results were:

| | D |
|---|---|
| Fabric according to the invention | 23% |
| Fabric in which second adhesive application was omitted | 22% |

The second adhesive application produced virtually no change in drape, despite there being more than 9 $g.m^{-2}$ of additional adhesive applied to the fabric.

EXAMPLE 3

A base-web, weighing 12 $g.m^{-2}$ and having the same composition as the base-web of Example 1 was prepared and coated by the procedure of Example 1 with dispersal acrylic resin Primal HA8 manufactured by Rohm and Haas Limited) in water (15% solids) to give a weight of 3.7 $g.m^{-2}$ of adhesive on the web. Flock fibres, composed of nylon 66 and of mean length 0.3mm, were applied uniformly to both sides of the web by the apparatus described in our copending U.S. application Ser. No. 283,289 to a level of 28.7 $g.m^{-2}$. Part of the product obtained after drying, designated sample 3A, was retained.

The flocked fabric was then soaked in a dip tank containing a dilute solution of the acrylic resin used in the first stage of adhesive application, there being 1 part of adhesive to about 20 parts of water. After drying, it was found that 7.8 $g.m^{-2}$ adhesive had been applied to the web in the second stage of adhesive application.

The Cusick drape coefficient was measured for sample 3A and the finished product. In both cases it was found to be 24%.

EXAMPLE 4

A flocked fabric having the following composition was made by the procedure of Example 1.

| Component | Material | Weight $g.m^{-2}$ |
|---|---|---|
| Base-web | 100% bicomponent continuous filaments: core, nylon 66, sheath, nylon 6 | 12 |
| Adhesive | Acrylic resin (Primal HA8 supplied by Rohm and Haas Ltd) | 2 |
| | 1st appln as an emulsion, 1 part solid to 4 parts water | 2.8 |
| | 2nd appln as an emulsion, 1 part solid to 9 parts water | 5.3 |
| Flock fibres | $\alpha$-cellulose | 15.8 |
| Flame retardant/ antistatic agent | Ammonium sulphamate | 6.8 |
| Water repellent agents | (i) FC451 Fluorochemical (supplied by Minnesota Mining & Mfg. Co.) | 0.2 |
| | (ii) Dipsanil V (Paraffin wax/aluminium dispersion) (supplied by Imperial Chemical Industries Ltd.) | 0.9 |
| Pigments | Monoprin Yellow 6N (15 parts) Monoprin Blue BX (5 parts) Monoprin Black (2 parts) (supplied by Imperial Chemical Industries Ltd.) | 0.6 |
| | TOTAL WEIGHT = 34.4 $g.m^{-2}$ | |

The product was a strong lightweight drapeable fabric of a dark green hue and was suitable for use as surgeons smocks and surgical drapes.

What we claim is:

1. A process for making a substantially lint-free flocked fabric comprising sequentially the steps of a. forming a base-web comprising non-woven thermoplastic fibrous material, b. treating the base-web to bond together said non-woven fibrous material thereby forming a bonded base-web, c. applying to the bonded base-web a uniform amount of adhesive as a solution, emulsion or suspension of 1 part of an adhesive to 1–4 parts liquid, d. applying flock fibres to the adhesive so that said flock fibres adhere to the fibrous material of the base-web, e. drying the adhesive, f. immersing the base-web and adhered flock fibres in a solution, emulsion or suspension containing 1 part of an adhesive to 4–40 parts of liquid, and g. drying the adhesive.

2. A process as claimed in claim 1, wherein the base-web comprises continuous conjugate filaments having a potentially adhesive component which is activated in step (b).

3. A process as claimed in claim 1, wherein step (b) is accompanied by the application of pressure.

4. A process as claimed in claim 1, wherein the solution of adhesive applied in step (f) contains additives selected from the following group: flame retardant agents, water repellent agents, antistatic agents and pigments.

5. A process as claimed in claim 1, wherein the adhesive is curable and is cured in step (g).

6. A process as claimed in claim 1, wherein the adhesive is curable, and is cured in both step (e) and step (g).

7. A flocked fabric, comprising a base-web of non-woven bonded thermoplastic fibrous filaments being coated with a uniform amount of adhesive in a first dilute solution, emulsion or suspension to which flock fibres are adhered, said flock fibres and at least some of said filaments being substantially completely coated with dried adhesive from a second dilute solution, emulsion or suspension having a concentration of adhesive between one quarter and one tenth of the concentration of the adhesive in said first dilute solution, emulsion or suspension.

8. A flocked fabric as claimed in claim 7, wherein the base-web comprises continuous filaments.

9. A flocked fabric as claimed in claim 8, wherein at least a proportion of the continuous filaments are multicomponent and are bonded to each other by bonds derived from one component.

10. A flocked fabric as claimed in claim 7, wherein said flock fibres are $\alpha$-cellulose.

11. A flocked fabric as claimed in claim 7, wherein additives selected from the following group are incorporated: flame retardant agents, water repellent agents, antistatic agents and pigments.

12. A flocked fabric as claimed in claim 7 having a drape coefficient (as herein defined) of less than about 50%, preferably less than about 30%, comprising a baseweb of continuous filaments, having a first core component of nylon 66 and a second sheath component of nylon 6 completely surrounding said core component, said base-web weighing between 10 and 15 $g.m^{-2}$, the filaments being bonded at cross-over points, and $\alpha$-cellulose flock fibres adhered to the filaments of the base-web at a density of between 10 and 20 $g.m^{-2}$, said flock fibres being oriented in all directions and some preferably a majority penetrating into or through the base-web, and said flock fibres being substantially completely coated with dried adhesive.

* * * * *